US011285512B2

(12) United States Patent
Barnett

(10) Patent No.: US 11,285,512 B2
(45) Date of Patent: Mar. 29, 2022

(54) SYSTEM, METHOD AND APPARATUS FOR A VACUUM DRIVEN GOLD SIFTER

(71) Applicant: Allen Robert Barnett, Crossplains, TX (US)

(72) Inventor: Allen Robert Barnett, Crossplains, TX (US)

( * ) Notice: Subject to any disclaimer, the term of this patent is extended or adjusted under 35 U.S.C. 154(b) by 0 days.

(21) Appl. No.: 17/143,809

(22) Filed: Jan. 7, 2021

(65) Prior Publication Data

US 2022/0032342 A1 Feb. 3, 2022

Related U.S. Application Data

(60) Provisional application No. 63/059,138, filed on Jul. 30, 2020.

(51) Int. Cl.

| | |
|---|---|
| ***B07B 1/42*** | (2006.01) |
| ***B07B 1/28*** | (2006.01) |
| ***B07B 1/00*** | (2006.01) |
| ***B07B 1/36*** | (2006.01) |

(52) U.S. Cl.

CPC ..... *B07B 1/284* (2013.01); *B07B 1/005* (2013.01); *B07B 1/36* (2013.01); *B07B 1/42* (2013.01)

(58) Field of Classification Search

CPC ..... B07B 1/005; B07B 1/284; B07B 1/36; B07B 1/42; B07B 15/00; B03B 4/06

See application file for complete search history.

(56) References Cited

U.S. PATENT DOCUMENTS

| | | | | |
|---|---|---|---|---|
| 161,875 | A * | 4/1875 | Gathmann | A01F 12/44 209/26 |
| 244,114 | A | 7/1881 | De Soulages | |
| 264,023 | A * | 9/1882 | Andrews et al. | B02B 7/02 99/488 |
| 443,901 | A | 12/1890 | Craig | |
| 507,488 | A * | 10/1893 | Davidson | B07B 4/02 209/33 |
| 664,626 | A | 12/1900 | Oleshak | |
| 1,211,495 | A | 1/1917 | Shore | |
| 1,856,836 | A | 5/1932 | Howell | |
| 1,864,926 | A | 6/1932 | Moss | |
| 2,195,541 | A | 4/1940 | Schierding | |
| 2,208,141 | A | 7/1940 | Eisenhand | |
| 2,231,941 | A | 2/1941 | Ohman | |
| 2,899,216 | A | 8/1959 | Brock | |
| 3,255,886 | A | 6/1966 | Hardy | |
| 3,702,682 | A * | 11/1972 | Williams | B03B 9/061 241/48 |
| 3,874,732 | A | 4/1975 | Krivda | |
| 4,289,355 | A | 9/1981 | Rose | |

(Continued)

FOREIGN PATENT DOCUMENTS

| | | |
|---|---|---|
| CN | 2229557 Y | 6/1996 |
| CN | 101703962 B | 9/2013 |

(Continued)

OTHER PUBLICATIONS https ://www.youtube.com/watch?v=IHcFJaUXQeg Gold Mining Dry Washer—How to Maximize Recovery; Jun. 23, 2017; Allan's Gold Mining.

*Primary Examiner* — Joseph C Rodriguez
(74) *Attorney, Agent, or Firm* — Michael Roebuck

(57) ABSTRACT

A system and method for a vacuum driven separating device is disclosed.

16 Claims, 7 Drawing Sheets

(56) References Cited

U.S. PATENT DOCUMENTS

| | | | |
|---|---|---|---|
| 4,359,383 | A | 11/1982 | Sweet |
| 4,400,269 | A | 8/1983 | Montigny |
| 4,423,559 | A | 1/1984 | Malin |
| 4,472,269 | A | 9/1984 | Swick |
| 4,525,270 | A | 6/1985 | McCann |
| 4,673,492 | A | 6/1987 | Jasinski |
| 4,860,874 | A | 8/1989 | Winderl |
| 5,255,787 | A | 10/1993 | Sims |
| 5,425,188 | A | 6/1995 | Rinker |
| 5,456,738 | A | 10/1995 | Gil |
| 5,957,303 | A | 9/1999 | Krenzler |
| 6,079,130 | A | 6/2000 | Freeman |
| 6,102,211 | A | 8/2000 | Bartkoski |
| 6,957,506 | B1 | 10/2005 | Fair |
| 7,591,088 | B1 | 9/2009 | Schuh |
| 9,823,169 | B1 | 11/2017 | Witt, III et al. |
| 2010/0193406 | A1 | 8/2010 | Alderson |
| 2011/0047743 | A1 | 3/2011 | Shepherd |
| 2013/0209181 | A1 | 8/2013 | Van Arsdale |

FOREIGN PATENT DOCUMENTS

| | | | |
|---|---|---|---|
| CN | 205346884 | U | 6/2016 |
| GB | 190309501 | A | 6/1903 |
| GB | 2056528 | A | 3/1981 |
| RU | 2221114 | C1 | 1/2004 |
| UA | 7202 | U | 6/2005 |
| WO | WO2007108707 | A1 | 9/2007 |
| WO | WO2012060691 | A2 | 5/2012 |

* cited by examiner

SYSTEM, METHOD AND APPARATUS FOR A VACUUM DRIVEN GOLD SIFTER

CROSS REFERENCE TO RELATED APPLICATIONS

This patent application claims priority from US Provisional patent application by Barnett, entitled "A System and Method for a Vacuum Driven Gold Sifter" filed on Jul. 30, 2020 and assigned Ser. No. 63/059,138, which is hereby incorporated by reference in its entirety.

BACKGROUND OF THE INVENTION

Numerous devices are available to assist in separating for gold. There is a need for a more efficient separating device.

FIELD OF THE INVENTION

The invention relates to a separating device. In particular the invention is in the field of separating gold from a dirt mixture.

SUMMARY OF THE INVENTION

An illustrative embodiment of a system, method, and apparatus for separating gold from a mixture are disclosed.

BRIEF DESCRIPTION OF THE DRAWINGS

The drawings presented herein are for illustrative purposes only and do not limit the scope of the claims. Rather, the drawings are intended to help enable one having ordinary skill in the art to make and use the claimed inventions.

DETAILED DESCRIPTION OF THE INVENTION

Figure 1:
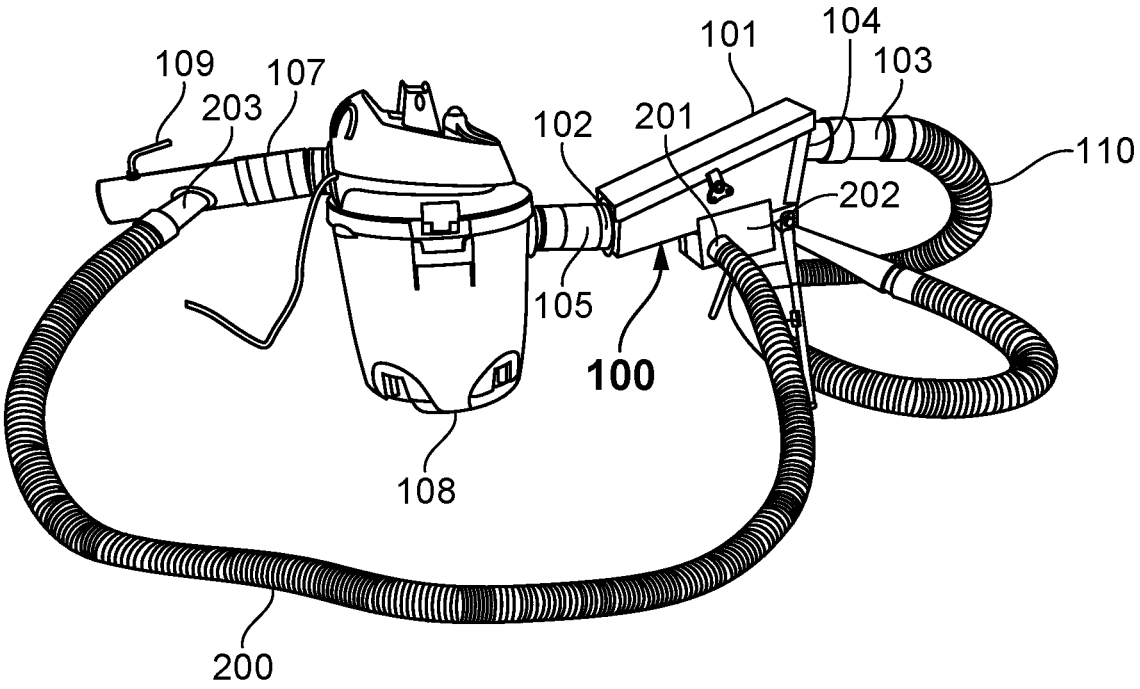
FIG. 1 is a schematic depiction of a side view of a particular illustrative embodiment of the invention.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims. In a particular illustrative embodiment of the present invention discloses a vacuum driven gold sifter is disclosed including but not limited to the following features.

In a particular illustrative embodiment of the invention, a vacuum driven gold separating device system (which are collective referred to herein generally as a "separating device") includes but is not limited to, a vacuum air flow driven spin wheel, a deflector plate, an eccentric weight attached to an axel at the center rotation of the spin wheel for the that creates a vibration of a separating device housing. The separating device housing includes but is not limited to a metal mesh, a ribbed rubber mat, a shop vacuum cleaner, and a pair of height adjustable legs. The ribbed rubber mat sits on the bottom of the housing. The metal mesh sits on top of the rubber mat.

In a particular illustrative embodiment of the invention, a separating device housing is provided with an air outlet port formed on a first end of the separating device housing is attached to the shop vacuum that creates suction airflow is disclosed. Presorted materials forming a what is referred to herein as a "mixture" are fed or pulled into the separating device housing through the shop vacuum hose using the vacuum created by the vacuum cleaner. The mixture can include but is not limited to materials such as minerals, rocks, dirt, limestone, black sand, and gold. The black sand and gold are heavier than other materials that are collected at the bottom and the other lighter materials such as minerals, rocks, dirt, and limestone pass through the device. The presorted materials pulled by the airflow from the vacuum, strikes a deflector plate wherein a combination of striking the plate and entering a larger volume decreases the momentum of the materials flowing through the device.

The air flow is deflected by a spin wheel housing contain a plurality of spin blades on an axle with an eccentric weight attached to one side of a set of spin blades on a spin wheel that spin in reaction to the air flow. The eccentric weight is attached to the axis of the spin wheel that causes the separating device housing to vibrate the separating device housing as the spin wheel and eccentric weight spins. The vibration helps the heavier materials in the mixture, such as the heavier black sand and gold settle to the bottom of the device and remaining lighter materials in the dirt mixture are sucked by the air flow from the vacuum, through the separating device housing and into the vacuum for disposal. The heavier materials fall to the bottom of the separating device housing through the expanded metal mesh to the valleys between the ribs of the rubber mat where the gold particles and black dirt remain for removal and retrieval. A pair of height adjustable legs are provided to support the separating device housing while attached to the shop vacuum.

In another particular embodiment, the spin blade housing is attached underneath the separating device housing. In this embodiment, a portion of the air from the vacuum hose is routed back in an air return hose to the spin blade housing mounted underneath the separating device housing. The air returned to the spin blade housing causes the spin blades and eccentric weight to rotate about the spin wheel axis. The spinning of the eccentric weight causes a vibration that is transferred to the separating device housing. An air flow valve having an air flow valve handle is positioned inside of a return hose coupling which connects the return hose to air outlet port. The air flow valve controls how much of air is supplied to the air return hose that is allowed to flow through the return hose to rotate the spin blades. The air flow valve is a rotating valve with an "L" shaped air valve handle so that the return valve is totally blocked or totally open or in between so that a user can adjust the amount of air returned to the spin wheel housing through the air return hose and how much vibration is created by the eccentric weight spinning under the influence of the return air impacting the spin blades.

A particular illustrative embodiment of the invention is disclosed herein. A shop vacuum creates suction air flow and is attached to one end of the separating device housing. The mixture of presorted materials containing minerals, rocks, dirt, limestone, black sand, and gold enters the separating device housing as the vacuum sucks the mixture into the separating device housing. The black sand and gold are heavier than the other materials and are separated out to the bottom of the separating device housing, while the lighter materials pass through the separating device housing. The vacuum creates air flow that pulls the materials through the separating device housing, into the air inlet port and out of the air outlet port formed in the separating device housing, minus the heavier materials that remain in the separation device housing. The air flow from the vacuum pulls the mixture of materials through the separating device housing where the materials first entrained in the air flow, strike a deflector plate wherein a combination of striking the plate and entering a larger volume from the inlet hose and inlet port to the greater volume of the separating device housing, decreases the momentum of the materials flowing through the separating device housing. The air flow is deflected by a deflector plate toward a spin wheel housing to one side of a set of blades on a spin wheel that spins in reaction to the air flow deflected into the spin wheel housing onto the spin blades.

An eccentric weight is attached to one side of the axis of the spin wheel that causes the separating device housing to shake as the spin wheel and eccentric weight spin around an axis of the spin wheel. The vibration induces the heavier materials in the mixture, the black sand and gold settle to the bottom of the separation device housing. The remaining materials in the mixture are sucked out of the separating device housing through the outlet port and into the vacuum for disposal. The heavier materials in the mixture are captured in the bottom of the separation device housing in an expanded metal mesh over a ribbed rubber mat positioned in a bottom of the separating device housing. The gold particles fall to the bottom of the separating device housing through the expanded metal mesh to the valleys between the ribs of the rubber mat, where the gold particles and black dirt remain for removal and retrieval. The mixture of materials is fed to the separating device housing using the shop vacuum hose attached to the air inlet port formed in the separating device housing. A pair of height adjustable legs are provided to support the separating device housing while attached to the shop vacuum. The shop vacuum is electric operated and plugs into an alternating current source. In an alternative embodiment of the invention, the vacuum is gas powered. In another embodiment, the vacuum is battery powered.

Turning now to FIG. 1, as shown in FIG. 1 a separating device housing 100 having a top 101 is shown attached to a commercially available wet dry shop vacuum 108, such as the Shop-Vac TRADEMARK®. The separating device housing 100 is supported by a pair of legs 106. A first end of the separating device housing has a round opening or "air outlet port" 102 attached to an input of the vacuum source (shop vacuum 108) and a second round opening, an "air inlet port" 104 in the other end of the separating device housing is attached to shop vacuum suction input hose 103 to receive a mixture of materials including but not limited to a mixture, fed into the separating device housing by and through the separating device housing to the shop vacuum. Air outlet hose 105 attaches to the air outlet port 102. The mixture is processed by the separating device as described herein and the heavier portions of the mixture that do not remain in the separating device housing are passed through to the shop vacuum as a separated mixture. The separated mixture and air from the separating device housing enters the shop vacuum through outlet hose 105. The shop vacuum filters the separated mixture to remove the separated mixture and the air entering the shop vacuum is exhausted from the shop vacuum through the vacuum exhaust hose 107. An air return hose input connector 203 is connected to vacuum exhaust hose 107 to air return hose 200. A portion the exhaust air from the shop vacuum is diverted into an air return hose 200. Air valve handle 109 is connected to an air valve (not shown) positioned inside of the vacuum exhaust hose. The air valve is circular and the same size as the internal diameter of the vacuum exhaust hose. The air valve swivels under the influence of the air valve handle, to block between 0 and 100 percent of the air exhausted from the shop vac through the vacuum exhaust and in so doing controls the amount of air entering the air return hose 200 through air return hose input connector 203. Thus the amount of air flowing through the air return hose is controlled by positioning the air valve using air valve handle 109. The air return hose connects to the air return hose nozzle 201 connected to the external spin blade housing 202. The external spin blade housing 202 attached outside and on the bottom of the separating device housing 100 so that the air from the air return hose impact the spin blades causing the spin blades to rotate. The rotation of the spin blades 118 and eccentric weight 119 causes a vibration that vibrates the separating device housing. An air inlet hose 110 is shown for receiving and sucking materials into the separation device housing.

Figure 2:
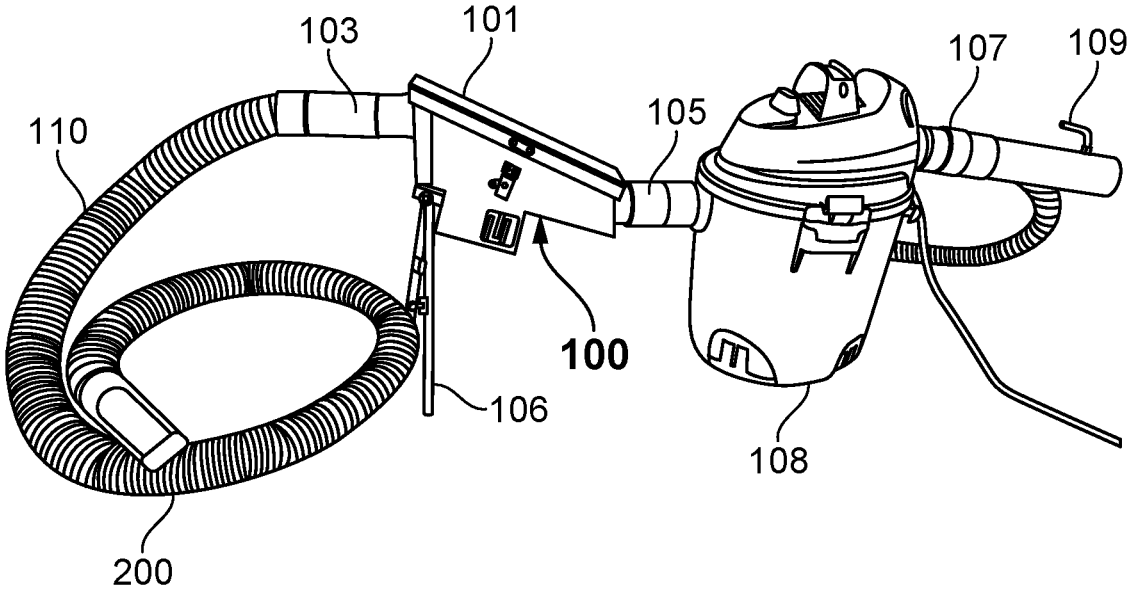
FIG. 2 is a schematic depiction of a side view of a particular illustrative embodiment of the invention.
Figure 3:
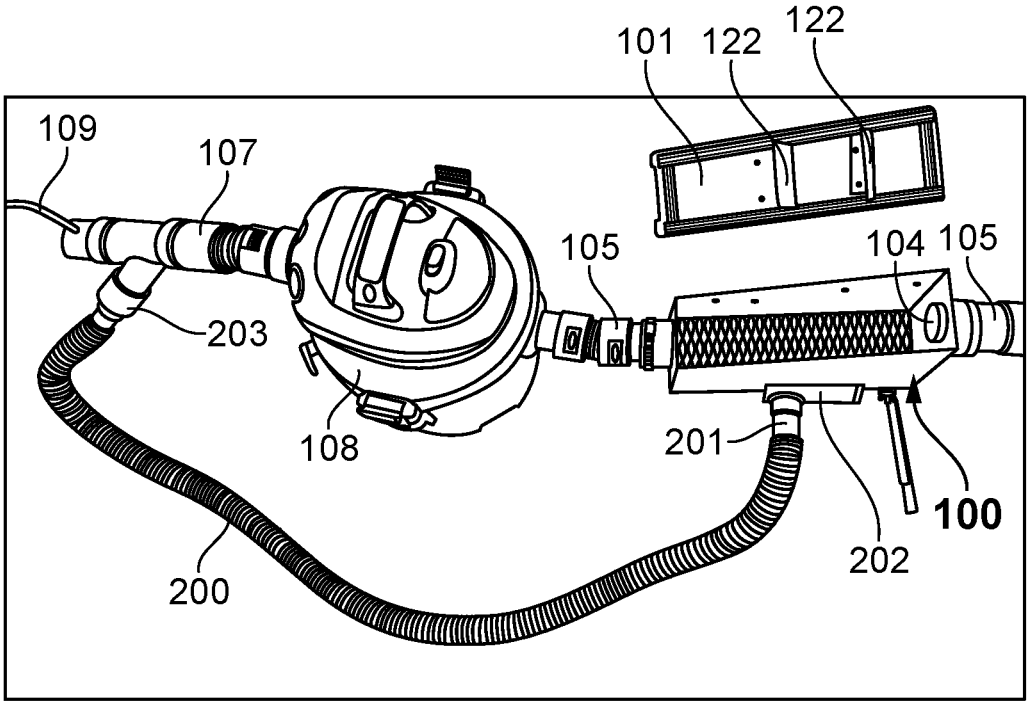
FIG. 3 is a schematic depiction of a top view of a particular illustrative embodiment of the invention.

Turning now to FIG. 2 and FIG. 3, in a particular illustrative embodiment of the invention the shop vacuum 108 is shown attached to the separating device housing 100 at the air inlet port 104 via hose 105.

Figure 4:
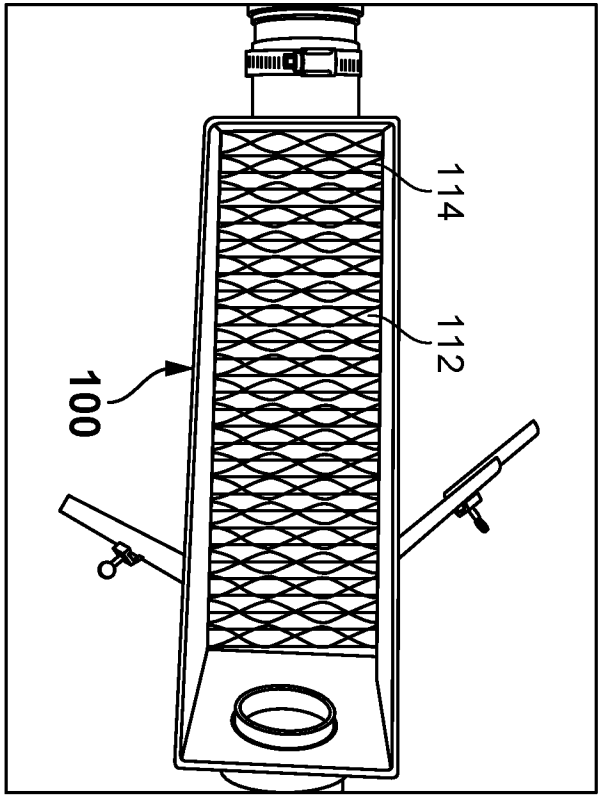
FIG. 4 is a schematic depiction of a top view of a particular illustrative embodiment of the invention.

Turning now to FIG. 4, as shown in FIG. 4 is a top view of a particular illustrative embodiment of the invention. As shown in FIG. 3, a metal mesh 114 lays on top of a ribbed rubber mat 112.

Figure 5:
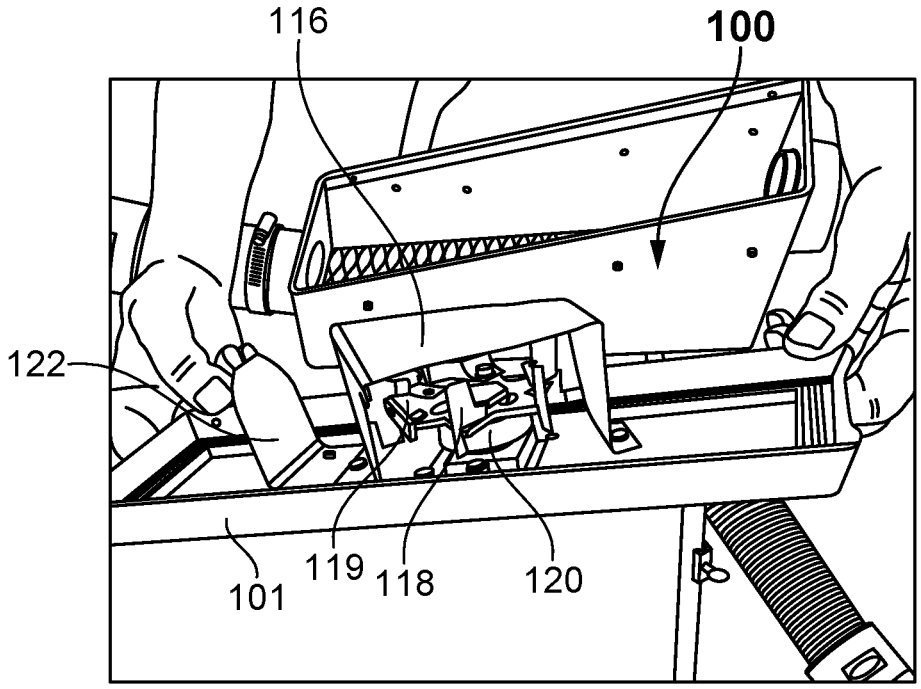
FIG. 5 is a schematic depiction of a perspective view of a particular illustrative embodiment of the invention.

Turning now to FIG. 5, FIG. 5 is a perspective view of a particular illustrative embodiment of the invention. As shown in FIG. 5, an internal spin blade housing 116 is attached to the top 101 of the separating device housing and positioned inside the top 101 of the separation device housing so that air flow inside of the separation device housing is used to impact the spin blades on the spin wheel inside of the separation device housing. The spin blade housing is open on one side and angled so that the air flow inside of the separation device housing, created by vacuum suction goes into one side of the spin blade housing forces the spin blades to rotate around a spin blade axis. The spin blade housing contains a plurality of spin blades 118 are mounted on and around a spin wheel axis 120. The air flow is deflected by a spin wheel housing a to one side of a set of blades on the spin wheel that rotates in reaction to the air flow. An eccentric weight 119 is attached to the axis of the spin wheel to which the spin blades are attached rotate about a central axis under influence of the air flowing through the separating device housing to the shop vacuum. The eccentric weight causes an off balance spin of the spin blades and creates a vibration. The vibration of the eccentric weight on the rotating spin blade axel causes the separating device housing to vibrate as the wheel spins. The vibration urges the heavier materials in the mixture, the black sand and gold, to settle to the bottom of the separating device housing. The remaining particles are sucked through the separating device housing and into the shop vacuum for disposal. The heavier materials in the mixture are captured in the bottom of the device consisting of an expanded metal mesh 114 over a ribbed rubber mat 112. The heavier gold particles fall to the bottom of the device through the expanded metal mesh and into the valleys between the ribs of the rubber mat positioned underneath the expanded metal mesh, where the heavier gold material and black dirt remain for removal and retrieval. The materials in the form of a mixture, are fed into the separation device under the influence of the vacuum generated by the shop vacuum using the shop vacuum hose. A pair of height adjustable legs 106 are provided to support the separating device housing while attached to the shop vacuum. In a particular illustrative embodiment of the invention the air causes the spin blades 118 to rotate the eccentric weight 119 to create vibration this is transferred to the separating device housing.

Figure 6:
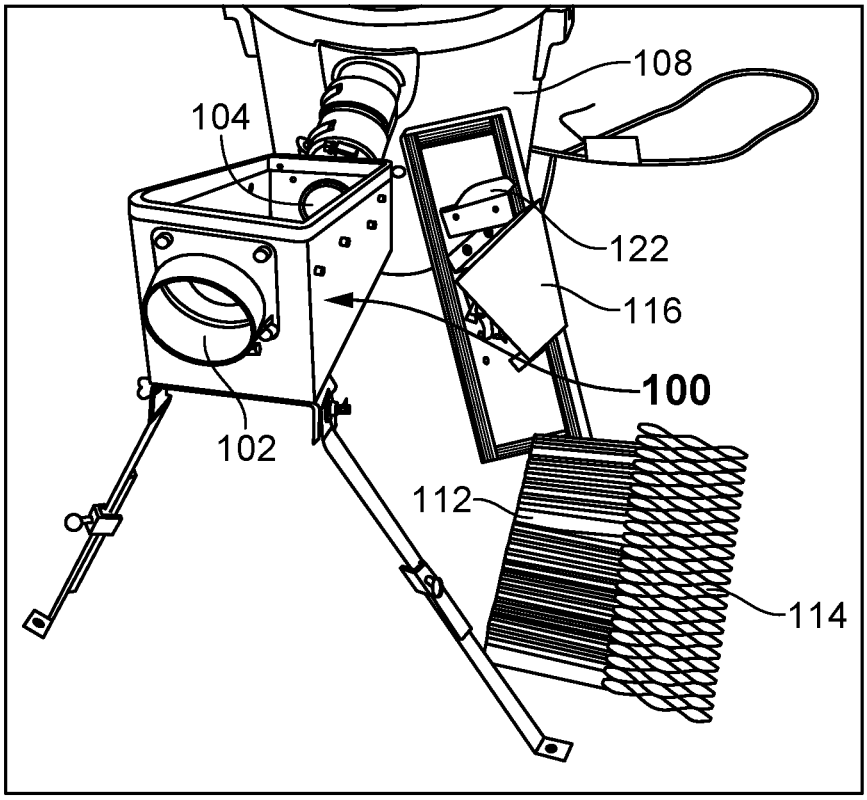
FIG. 6 is a schematic depiction of a front view of a particular illustrative embodiment of the invention.

FIG. 6 is a front view of a particular illustrative embodiment of the invention showing the internal spin blade housing 116 attached to the top 101 of the separating device housing 100 and inside of separating device housing, so that spinning of spin blades 118 vibrates the separating device housing. The internal spin blade housing 116 and deflection plate 122 attached to the spin blade housing top 101 are shown in FIG. 6.

Figure 7:
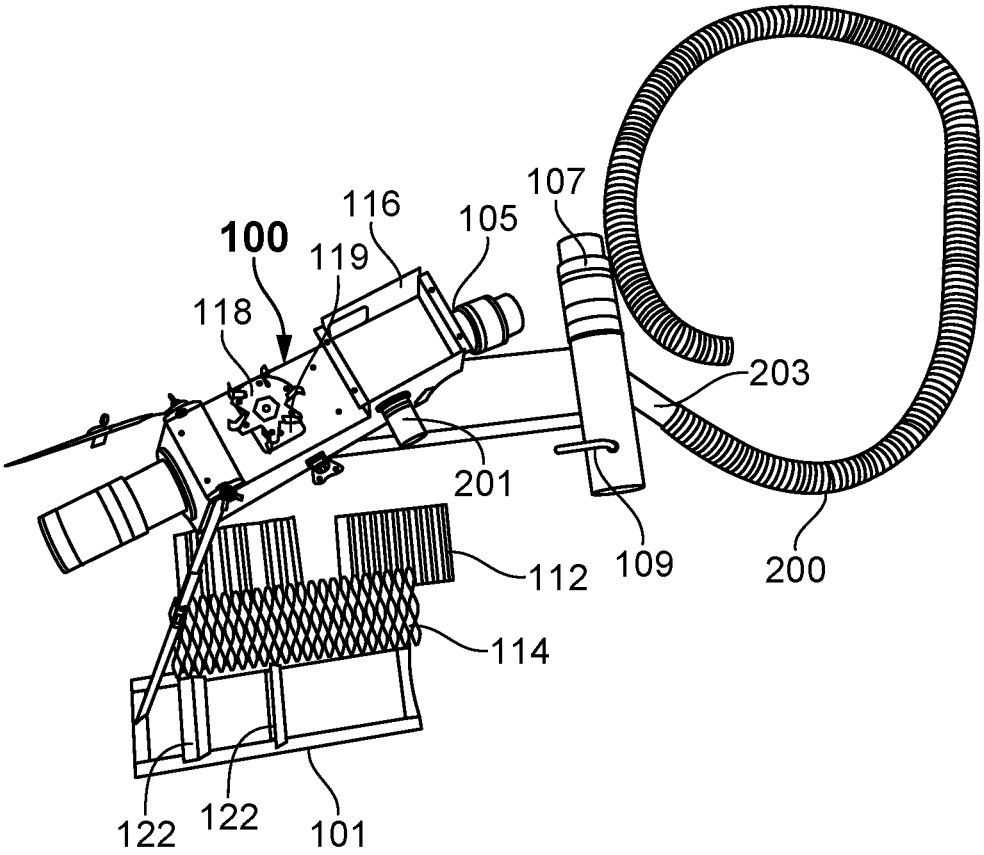
FIG. 7 is a schematic depiction of top view of a particular illustrative embodiment of the invention.

FIG. 7 is a perspective view of a particular illustrative embodiment of the invention showing the rubber mat 112 in the bottom of the separating device housing. The wire mesh 114 on top of the rubber mat 112 in the bottom of the separating device housing 100. The spin blade housing is attached to the outside of the bottom of the separating device housing 100. Two deflector blades 122 are attached to an inside of the top 101 of the separating device housing. An exit nozzle provides an exit for air exiting the separating device housing. A portion of the exiting air is routed from exit nozzle 107 through hose 200 back to air return hose nozzle 201 on the internal spin blade housing 116. The spin blades 118 are shown separated from the internal spin blade housing which are normally positioned inside of the internal spin blade housing adjacent the air return hose nozzle 201 during normal operations. The air entering the nozzle 201 causes a plurality of spin blades 118 positioned inside of the spin blade housing 116 to rotate the eccentric weight 119 to cause the separating device housing to vibrate and urge the heavier material in the mixture such as gold particles, to drop down to the rubber mat in the bottom of the separating device housing. Vacuum air exits the separating device housing through exit hole 105. The eccentric weight 119 and spin blades 118 attached to spin blade wheel that rotates under the influence of the blade air entering the spin blade housing from hose 200. The air output port 107 and exit nozzle 203 routing air to hose 200 to the spin blade housing 116.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

Certain specific embodiments of methods, structures, elements, and parts are described below, which are by no means an exclusive description of the inventions. Other specific embodiments, including those referenced in the drawings, are encompassed by this application and any patent that issues therefrom.

The invention claimed is:

1. An apparatus for separating gold from a mixture, the apparatus comprising:

a separating device housing;

an air intake port on a first end of the separating device housing for receiving a mixture;

an air outlet port on a second end of the separating device housing;

an air vacuum source attached to the outlet port;

a spin wheel having a plurality of spin blades mounted radially around a spin wheel axis, wherein the spin wheel is configured to spin under the influence the air entering the air intake port and striking the spin blades; and an eccentric weight attached to the spin wheel axis configured to cause a vibration in the separating device housing.

2. The apparatus of claim 1, a spin wheel housing mounted on the inside of the separating device housing wherein the spin wheel housing contains the spin wheel, wherein the spin wheel is mounted inside of the separating device housing.

3. The apparatus of claim 2, the apparatus further comprising a deflector plate attached to an inside of a top of the separating device housing, wherein the deflector plate is configured to deflect the mixture.

4. The apparatus of claim 3, wherein the spin wheel housing directs air from the air intake port to the spin wheel configure to cause the spin wheel to rotate.

5. The apparatus of claim 4, the apparatus further comprising a mesh placed in a bottom of the separating device housing and a ribbed member placed underneath the mesh in a bottom of the separating device housing.

6. The apparatus of claim 5, further comprising:

a spin wheel housing enclosing the spin wheel, wherein the spin wheel housing is mounted outside of the separating device housing, the apparatus further comprising an air return hose connected between the outlet port and the spin wheel housing, wherein the air return hose is configured to directs air from the air return hose onto the spin blades to cause the spin blades to rotate.

7. The apparatus of claim 6, the apparatus further comprising a ribbed member placed underneath a mesh in a bottom of the separating device housing.

8. The apparatus of claim 5, the apparatus further comprising an air valve located in the air return hose, wherein the air valve is configured to control a volume of air flowing through the air return hose to control an amount of the vibration in the separating device housing.

9. The apparatus of claim 1, wherein the spin wheel is mounted outside of the separating device housing.

10. The apparatus of claim 9, the apparatus further comprising a deflector plate configured to direct intake air from the air intake port to the spin wheel.

11. The apparatus of claim 10, the apparatus further comprising a mesh placed in a bottom of the separating device housing.

12. The apparatus of claim 11, the apparatus further comprising a ribbed member placed underneath the mesh in a bottom of the separating device housing.

13. The apparatus of claim 12, further comprising:

a spin wheel housing enclosing the spin wheel, wherein the spin wheel housing is mounted outside of the separating device housing, the apparatus further comprising an air return hose connected between the outlet port and the spin wheel housing.

14. A method, the method comprising:

flowing air and a mixture into an air intake port on a first end of a separating device housing;

receiving a portion of the air flowing into the air intake port on a a spin wheel having a plurality of spin blades mounted radially around a spin wheel axis and an eccentric weight attached to the spin wheel axis; and rotating the spin wheel with the air receiving at the spin wheel; and generating a vibration in the separating device housing from the eccentric weight.

15. The method of claim 14, wherein the spin blades are mounted in outside of the separating device device housing, the method further comprising:

receiving air exiting the separating device device housing; and returning a portion of the air exiting the separating device device housing flowing to the spin;

vibrating the separating device housing.

16. The method of claim 15, further comprising:

controlling a volume of the portion of air returning to the spin wheel housing to control a rotation of the spin blades and an amount of vibration generated in the separating device housing.

* * * * *